United States Patent [19]

Cooney et al.

[11] Patent Number: 4,771,943

[45] Date of Patent: Sep. 20, 1988

[54] TRAIN TRACK AND TRACK BED ASSEMBLY

[75] Inventors: Daniel J. Cooney, Birmingham; D. Michael Ledyard, Grosse Pointe, both of Mich.

[73] Assignee: Lionel Trains, Inc., Mt. Clemens, Mich.

[21] Appl. No.: 53,149

[22] Filed: May 21, 1987

[51] Int. Cl.[4] ..... E01B 23/00

[52] U.S. Cl. ..... 238/10 E; 238/10 R; 238/141; 238/278

[58] Field of Search ..... 238/10 R, 10 A, 10 E, 238/43, 83, 141, 264, 278

[56] References Cited

U.S. PATENT DOCUMENTS

| | | | |
|---|---|---|---|
| 1,983,776 | 12/1934 | Rosenthal | 238/10 E |
| 3,620,451 | 11/1971 | Richter | 238/10 E |
| 4,196,850 | 4/1980 | Cleminson | 238/10 E |
| 4,260,104 | 4/1981 | Schaffan | 238/10 E |

FOREIGN PATENT DOCUMENTS

| | | | |
|---|---|---|---|
| 405136 | 7/1966 | Switzerland | 238/10 E |

OTHER PUBLICATIONS

"PEMCO Precision Engineered Models," PEMCO Industries, Inc. Box 596, Montville, NJ 07045, 1984.

*Primary Examiner*—A. Michael Chambers
*Attorney, Agent, or Firm*—Edward J. Timmer

[57] ABSTRACT

A train track bed includes an elongated slot therein and a track rail includes a bottom flange that is supported by the track bed. A bendable locking tab is formed on the bottom flange of the rail. The locking tab is bent into the slot in the bed to restrain longitudinal movement of the rail on the bed while the bottom flange of the rail is received between opposing rail-holding flanges on the bed that restrain other movement of the track. Preferably, the track includes oppositely extending bottom flanges formed of sheet metal folded back upon itself with each flange having a depending side wall at the outermost lateral extremity of the flange to form a recess between the side walls. A pair of raised support ribs extends from the track bed into the recess to engage the underside of the flanges to support the rail on the track bed. The side walls hide the raised support ribs from view.

25 Claims, 2 Drawing Sheets

TRAIN TRACK AND TRACK BED ASSEMBLY

FIELD OF THE INVENTION

The invention relates to assemblies of track rail and track bed for wheeled vehicles, especially for toy trains, and to methods for assembling a track rail and track bed together.

BACKGROUND OF THE INVENTION

Various techniques have been used in the past to assemble a length of toy train track having one or more rails to the supporting cross-ties that constitute the supporting track bed. In one technique for assembling two or more lengths of roll formed sheet metal rail on formed sheet metal cross-ties, each cross-tie has been provided with bendable metal tabs that during assembly have been bent or crimped over and into engagement with a lateral bottom flange on opposite sides of the track rail to hold the rail and cross-ties together as a unitary assembly or section. In this type of track and bed assembly, individual sheet metal cross-ties are attached to the rail at multiple spaced locations along its length. Assembled sections of track and cross-ties are interconnected to form a continuous track for toy trains as is well known.

The roll-formed sheet metal rail for such assembled sections includes a pair of flanges extending in opposite directions from one another and having generally flat bottom surfaces to rest on the flat top of the cross-ties.

In another type of track and bed assembly for toy trains, the track bed has been formed of molded plastic such as polypropylene. The molded track bed includes multiple spaced apart cross-ties along its length with each cross-tie interconnected with an adjacent cross-tie by generally longitudinally extending parallel connector strips. The connector strips are spaced laterally apart a distance to form parallel support strips extending under each of a pair of track rails along their lengths. Each cross-tie includes molded resilient laterally opposing flanges between which lateral bottom flanges of each track rail are held or retained against lateral and vertical movement on the cross-tie.

Sections of the assembled track and molded bed are interconnected to other sections by special sheet metal connector clips that extend between the track of adjacent sections. One connector clip is attached to one of the track rails at one end of the assembled section and a similar clip is attached to the other of the track rails at the other end of the assembled sections.

Each connector clip is preformed to define an elongated channel to receive the bottom flange of the end of the rail. At the end of the channel receiving the rail, the connector clip includes a preformed depending tab extending transverse to the longitudinal axis of the clip; i.e., perpendicular to the track rail. An elongated slot is molded in the cross-tie and extends parallel with the longitudinal axis of the cross-tie (i.e., perpendicular to the track rail) and is positioned to receive the depending connector tab. The tab on the clip is not bent or deformed into the slot but instead is inserted in its preformed shape into the slot. After the tab of the clip is inserted into the slot in the track bed, each track rail is inserted through the elongated channel of the respective clip and through longitudinally aligned molded opposing flanges on the cross-ties with an end of each rail held in the respective clip by interference fit. An essentially pointed tool is then used to force or deform a dimple into the clip and into the track fail on the unsupported ends thereof to hold the clip onto the end of the rail, thereby retaining the track rail against movement longitudinally on the molded plastic bed.

The other track rail is similarly retained at the opposite end of the assembled section of track rail and molded plastic bed.

The track rail for use with the connector clips described has been extruded metal track having a solid bottom flange with a flat bottom surface to rest on the flat surface of molded plastic cross-ties and connector strips interconnecting the cross-ties.

SUMMARY OF THE INVENTION

The invention contemplates a track and bed assembly in which the track bed includes a slot or opening therein adjacent the track rail and the track rail includes a deformable or bendable locking tab that is bent into the slot and received therein to restrain longitudinal movement of the rail on the bed.

The invention also contemplates a method for assembling a track rail and bed by forming a locking tab on the rail, forming a slot or opening in the bed and deforming the locking tab into the slot when the rail and bed are juxtaposed.

The invention also contemplates a track rail having oppositely extending bottom flanges, preferably formed of sheet metal folded back upon itself, with the flanges each having a depending side wall adjacent their lateral extremity so as to define a recess between the side walls on the underside of the flanges. A track bed envisioned by the invention for use with such a track rail includes one or more raised support surfaces extending above the bed into the recess to engage and support the flanges from beneath.

In a preferred working embodiment of the invention, the track bed is a molded plastic one-piece bed having a plurality of cross-ties spaced apart along the length of the bed and interconnected by one or more integral connector strips extending between adjacent cross-ties. For a two rail track, the cross ties each have laterally spaced apart pairs of opposing rail-holding flanges between which the bottom flanges of a respective rail are restrained or held against lateral and vertical movement on the bed. Adjacent one pair of the opposing rail-holding flanges on one of the cross-ties supporting each rail, a deformable locking tab on a bottom flange of the rail is plastically bent into an elongate slot in the cross-tie beneath the flange with the slot sized to receive the locking tab to restrain longitudinal movement of the particular rail on the bed.

With the rails thereby restrained in position on the bed, a pair of raised support ribs provided on the connector strips nests in the recess defined between the depending side walls of the rail flanges with each support rib supportingly engaging a respective flange from beneath. The side walls are dimensioned to hide the support ribs from view.

BEST MODE OF PRACTICING THE INVENTION

Figure 1:
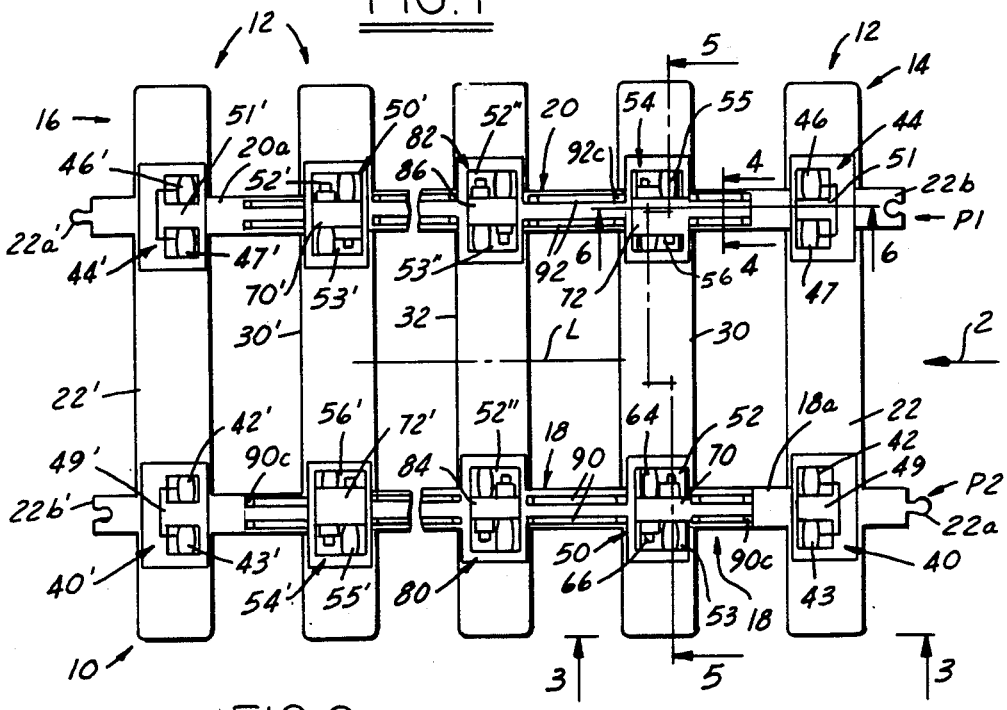
FIG. 1 is a plan view or top view of a section of the track bed (shortened in length for convenience) constructed in accordance with the invention.

Referring to FIGS. 1–6 and 10, a molded plastic track bed 10 constructed in accordance with the invention is illustrated. The bed 10 includes a plurality of cross-ties 12 spaced apart from one another along the length of the bed from end 14 to end 16. Each cross-tie 12 is interconnected to an adjacent cross-tie by parallel connector strips 18 and 20 which are molded integrally with the cross-ties 12, although they could be separate members fastened to the cross-ties by conventional fastening means.

All the cross-ties 12 are not configured the same. In particular, end cross-tie 22 and end cross-tie 22′ have male extension 22*a* or 22*a*′ and female extension 22*b* or 22*b*, extending therefrom and by which other track beds (not shown) can be connected thereto by mating male extensions of one bed with female extensions of another bed.

Adjacent each end cross-tie 22,22′ and disposed longitudinally inwardly thereof are specially configured cross-ties 30 and 30′ which will be discussed in detail hereinbelow.

Between special cross-ties 30 and 30′ are disposed a plurality of cross-ties 32 which are identical in configuration (only one tie 32 shown for convenience). The number of cross-ties 32 used will depend upon the overall length desired for the track bed 10.

Figure 2:
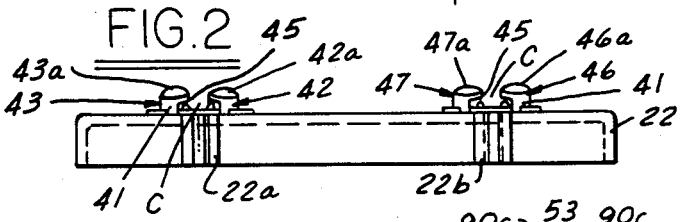
FIG. 2 is an end elevation of the track bed taken in the direction of arrow 2 of FIG. 1.
Figure 3:
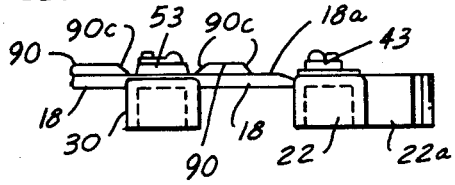
FIG. 3 is a partial side elevation of the track bed taken in the direction of arrows 3—3 of FIG. 1.

Referring now to FIGS. 2 and 3, it can be seen that end cross-tie 22 includes, in addition to the male and female extensions 22*a*,22*b*, a first pair 40 of laterally spaced apart rail-holding flanges 42,43 and second pair 44 of laterally spaced apart rail-holding flanges 46,47 molded integrally on the top surface thereof. A channel C is defined between flanges 42,43 to receive the track rail T; e.g., as shown on the left hand side of FIG. 10. A like channel is defined between flanges 46,47.

Each flange 42,43,46 and 47 are alike in construction, although the flanges in each pair extend oppositely toward one another. Each flange includes a vertical or upstanding wall 41 and a laterally extending wall 45. The width of flanges 42,43 and flanges 46,47 along the longitudinal axis L of the bed 10 is about one-half of that of the flanges on other cross-ties.

Each flange 42,43,46 and 47 includes a rounded top 42*a*,43*a*,46*a* and 47*a* to resemble or simulate the top of a spike used to fasten rail to cross-ties of real full-size train track.

Figure 6:
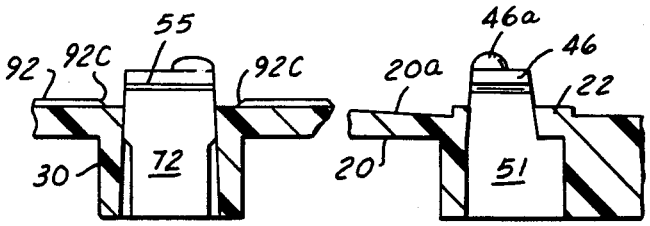
FIG. 6 is a partial longitudinal cross-sectional view of the connector strip and cross-tie taken along lines 6—6 of FIG. 1.

As best seen in FIGS. 1 and 6, a slot 51 is formed in end cross-tie 22 beneath pair 44 of opposing flanges 46,47. A similar slot 49 is formed in the cross-tie 22 beneath pair 40 of opposing flanges 42,43.

End cross-tie 22′ adjacent end 16 of the assembly is similar in construction to cross-tie 22 with the same features identified by like reference numerals primed but with some of the features described being spatially reversed to accommodate being on the opposite end of the track bed 10, as will be apparent from FIG. 1.

Figure 5:
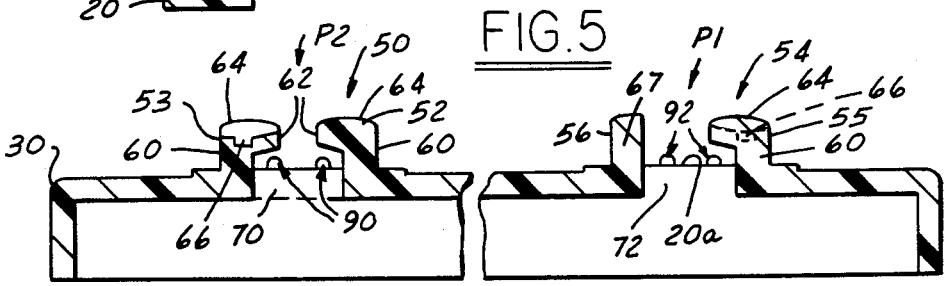
FIG. 5 is transverse cross-sectional view of a cross-tie of the track bed taken along lines 5—5 of FIG. 1.

Cross-sectional views through special cross-tie 30 are shown in FIGS. 5 and 6. Special cross-tie 30 includes a first pair 50 of laterally spaced apart opposing rail-holding flanges 52,53 and second pair 54 of rail-holding flanges 55,56.

Figure 10:
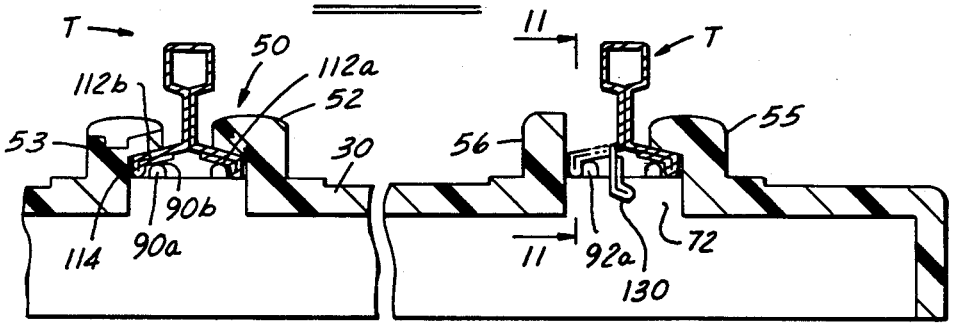
FIG. 10 is a cross-sectional view similar to FIG. 5 but with the track rails in position on the bed.

The flanges 52,53 of pair 50 are alike, although facing each other in opposite lateral directions. Each flange 52,53 includes a vertical or upstanding wall 60 and a laterally extending wall 62 that overlies the bottom flange of the track rail T as shown in FIG. 10. Flanges 52,53 define a channel therebetween in which the bottom flange of the track rail T is received. Flanges 52,53 have alike decorative features such as rounded simulated spike head 64 and a simulated tie down plate 66.

Flange 55 of pair 54 is identical in features to flanges 52,53. However, flange 56 of pair 54 is significantly modified as shown in FIGS. 1 and 5 to include only a vertical or upstanding wall 67 that is substantially parallel with the vertical wall of opposed facing flange 55

Beneath first pair 50 and second pair 54 of opposing rail-holding flanges are slots 70 and 72, respectively, in the bed 10.

The other special cross-tie 30′ adjacent the other end of the track bed 10 is configured alike to cross-tie 30 with like features represented by like reference numerals primed. However, it is apparent from FIG. 1 that pair 50′ of opposing flanges 52′,53′ and modified pair 54′ of flanges 55′,56′ are reversed in position.

Cross-tie 32 shown in FIG. 1 between special cross-ties 30 and 30′ includes a first pair 80 and second pair 82 of opposing laterally spaced apart flanges identical to the pair 50 described hereinabove for special cross-tie 30 wherein like features on the flanges of pairs 80 and 82 ar represented by like reference numerals double primed. Beneath each pair 80 and 82 of opposing flanges is a respective slot 84 and 86 like slot 70 beneath flange pair 50.

As shown best in FIG. 1, each cross-tie 10 is connected to an adjacent cross-tie by a pair of connector strips 18 and 20. Except for the connector strips between end cross-ties 22,22′ and the respective adjacent special cross-ties 30,30′, connector strips 18,20 include respective pairs of raised support ribs 90 and 92 extending longitudinally along the length of each connector strip. The support ribs 90 or 92 in each pair are substantially parallel with one another along their lengths.

Figure 4:
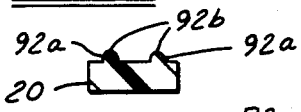
FIG. 4 is a transverse cross-sectional view of a connector strip taken along lines 4—4 of FIG. 1.

Support ribs 90,92 include a vertical or upstanding wall 90*a*,92*a* terminating in a rounded top support surface 90*b*,92*b* such as a radiused surface, FIGS. 4 and 10.

As shown best in FIGS. 2, 5 and 10, the support ribs 90,92 are laterally spaced apart on each respective connector strip 18 or 20 and extend upwardly therefrom.

Raised support ribs 90,92 terminate adjacent the cross-ties in tapered or chamfered surfaces or ramps 90*c*,92*c* that taper downwardly to the primary top surface 18*a*,20*a* of the connector strips.

It will be apparent to those skilled in the art that the pairs of opposing flanges on the cross-ties 12 and the connector strips 18,20 are longitudinally aligned along the length of the track bed 10 to define parallel support paths P1,P2 for a pair of track rails.

Figure 9:
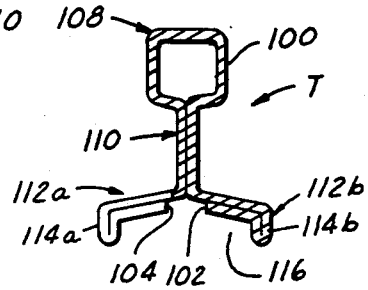
FIG. 9 is a transverse cross-sectional view of the track rail taken along lines 9—9 of FIG. 8.

Each rail T is identical except as explained below and is roll formed from a strip 100 of sheet metal such as brass or aluminum having longitudinally extending edges 102,104 on opposite sides of the strip. FIG. 9 illustrates the cross-section of each rail. Each rail T includes a top rail 108 of generally square cross-section on which the wheels of a toy train ride in known fashion.

Beneath the top rail 108 is a vertical support web 110 formed of a double thickness of the sheet metal strip. Formed beneath the support web 110 are oppositely extending lateral inner and outer bottom flanges 112*a*,112*b* that are formed of the sheet metal strip folded back upon itself to form depending vertical sidewalls 114*a*,114*b*. The strip is folded back to such an extent that the flanges 112*a*,112*b* have a double thickness of strip and that the longitudinal strip edges 102,104 terminate in spaced facing relation beneath the respective bottom flanges 112*a*,112*b*. A recess 116 is formed between the spaced depending side walls 114*a*,114*b*.

Figure 7:
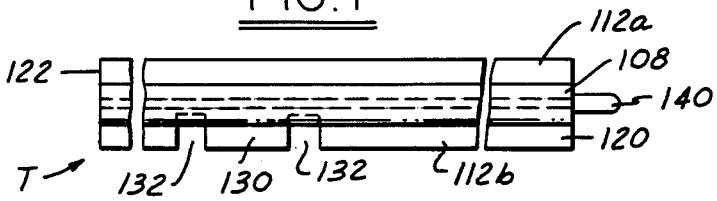
FIG. 7 is a plan view or top elevation of a length of track rail (shortened in length for convenience) constructed in accordance with the invention.
Figure 8:
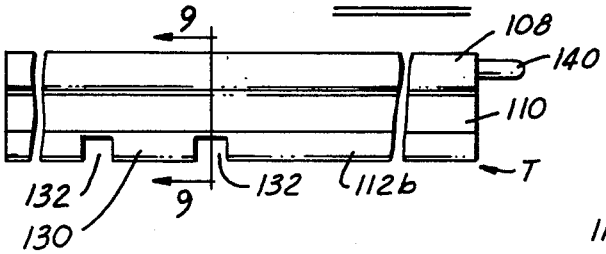
FIG. 8 is a side elevation of the track rail of FIG. 7.

A length of track rail T shortened for convenience is shown in FIGS. 7 and 8. The length of rail T includes a first end 120 and second end 122. Each length of rail T is adapted to be supported on a respective connector strip 18 or 20 and between the opposing rail-holding flanges that are aligned with the respective connector strip of FIG. 1.

In addition, a round metallic connector pin 140 is placed in one end of the top rail 108 of each rail T and crimped in position therein. This pin is inserted by friction fit into the opposing top rail of an adjacent track and bed assembly when the extensions 22*a*,22*a*′ and 22*b*,22*b*′ are mated and aids in holding adjacent track and bed assemblies together as well as providing electrical connection therebetween to complete the electrical circuit through the rails of adjacent assemblies.

Each track T is assembled to the track bed 10 by placing the bottom flanges 112*a*,112*b* onto the respective connector strip 18 or 20 with the bottom flanges 112*a*,112*b* received in the channel between opposing flanges on the cross-ties, as shown for example in FIG. 10. It is apparent that flanges 52,53 of pair 50 of cross-tie 30 retain the rail flanges 112*a*,112*b* against movement laterally and in the vertical direction. The other pairs of flanges, except modified pairs 54,54′, on the track bed 10 cooperate in the same way as shown in FIG. 10 to retain the track rail T against lateral and vertical movement on the bed.

Figure 11:
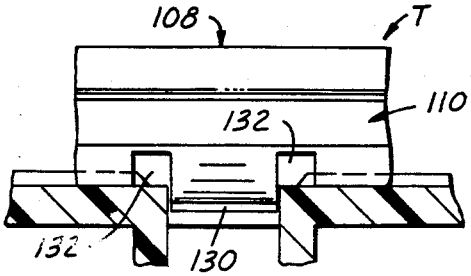
FIG. 11 is a partial sectional view along lines 11—11 of FIG. 10 showing the locking tab in the slot.

In proximity to modified pairs 54,54′ of opposing flanges on special cross-ties 30,30′, each track T includes a locking tab 130 that is formed between a pair of longitudinally spaced apart transverse notches or slots 132 in the inner rail flange 112*a*. For the track rail T positioned along path P1, the tab 130 will be located so as to overlie slot 72 in cross-tie 30. For the track rail T positioned along path P2, the tab 130 will be located so as to overlie slot 72′ in cross-tie 30′. As a result of the sheet metal construction of the track rail, tab 130 is plastically deformable or bendable from the position shown in dashed lines in FIG. 10 to the solid position in FIGS. 10 and 11. The length of slot 72 is selected to provide only slight clearance longitudinally of the tab 130 therein so that the locking tab 130 received in slot 72 effectively restrains longitudinal movement of the track rail along its length on the bed 10.

This same restraining action is achieved when the tab located over slot 72′ is plastically bent or deformed into that slot. The other track rail aligned on connector strips 18 along path P2 is thus restrained against longitudinal movement on the bed 10.

The length of each track rail T overlying the respective connector strips 18,20 is supported by the respective raised support ribs 90,92. In FIG. 10, it is clear that the round top surfaces of the respective support ribs 90 or 92 engage and support a respective flange 112*a*,112*b* in the recess 116 between side walls 114*a*,114*b*. The side walls 114*a*,114*b* extend downwardly from the flanges 112*a*,112*b* a distance sufficient to hide from view the raised support ribs 90,92. The lowermost portion of each side wall 114*a*,114*b* thus is substantially coplanar with the top surfaces 18*a*,20*a* of the connector strips 18,20.

The tapering ramps or surfaces 90*c*,92*c* on the opposite ends of the raised support ribs 90,92 function to help guide the rails smoothly into position during assembly.

The track rails as thusly assembled onto the bed 10 provide a unitary track and bed assembly that can be joined with other similar assemblies to form a continuous length of track and bed for a toy train or other wheeled vehicle.

Different track and bed assemblies are joined by mating of the male extensions 22*a*,22*a*′ and female extensions 22*b*,22*b*′ on one end of the assembly with the mating extension on an adjacent assembly.

Although the track bed 10 has been described hereinabove as one-piece molded plastic bed with the cross-ties interconnected by plastic strips 18,20, it is apparent that other track bed configurations can be employed in the invention. Likewise, other rail configurations can be employed in the invention and the number of rails can be varied to suit particular toy trains on the market.

Of course, the invention is equally applicable to curved track rail and bed assemblies as well as the straight rail and bed assembled illustrated in the figures and described hereinabove.

While there have been described in the foregoing specification preferred modes for carrying out the invention, it is my intent to cover in the appended claims all modifications and changes thereto as fall within the spirit and scope of the invention as set forth in the appended claims.

I claim:

1. A track and bed assembly comprising a support bed, an elongated track rail having a flange supported on the bed, said bed having an opening therein and said flange having a deformable locking tab that is bent into the opening to restrain longitudinal movement of the rail on the bed.

2. The assembly of claim 1 wherein the opening in the bed and the tab received in the opening extend substantially parallel with the track rail.

3. The assembly of claim 1 wherein the flange includes a pair of slots defining the tab therebetween.

4. The assembly of claim 1 wherein the bed includes multiple spaced apart cross-ties extending transversely relative to the track rail and wherein said opening is disposed in a cross-tie.

5. The assembly of claim 1 wherein the track rail is a roll-formed sheet metal rail.

6. The assembly of claim 1 wherein the opening in the bed is beneath the track rail.

7. A track rail and bed assembly comprising a support bed, an elongate track rail having oppositely extending lateral flanges supported on the bed, said bed having a slot therein beneath the track rail along a portion of its length, one of said flanges having a deformable tab that extends along a portion of the length of the rail and is bent into the slot to restrain longitudinal movement of the track rail on the bed.

8. The assembly of claim 7 wherein the bed includes multiple spaced apart cross-ties extending transversely relative to the track rail and wherein said slot is disposed in a cross-tie.

9. The assembly of claim 7 wherein the track rail is a roll formed sheet metal rail.

10. A method for assembling a track rail and bed with a flange on the track rail supported by the bed comprising:

(a) forming a deformable tab on the flange, (b) forming an opening in the bed that is adjacent the tab when the track rail and bed are juxtaposed in assembled relation, (c) juxtaposing the track rail and bed in assembled relation with the flange on the bed and bending the tab into the opening.

11. The method of claim 10 wherein in step (a) the tab is formed by forming spaced apart slots in the flange defining the tab therebetween.

12. The method of claim 11 wherein the slots are formed transversely into the flange to define a tab along the length of the flange.

13. The method of claim 12 where the opening in the bed is formed along the length of the flange adjacent the tab to receive the tab when it is bent.

14. The method of claim 13 wherein the opening is formed in the bed beneath the tab.

15. In combination, a track rail having oppositely extending lateral flanges with each flange terminating adjacent its lateral extremity in a depending side wall extending below the respective flange and having a recess defined between the side walls beneath the flanges, and a bed on which the track rail is supported, said bed having a raised support surface extending into the recess between the side walls for supporting the underside of the lateral flanges.

16. The combination of claim 15 wherein said support member includes a pair of laterally spaced apart support ribs extending longitudinally along a length of the track rail and toward and into the recess with one of the support ribs supporting one of said flanges and the other of the support ribs supporting the other of said flanges.

17. The combination of claim 15 wherein the bed includes a plurality of spaced apart cross-ties interconnected longitudinally by a connector strip and wherein the raised support surface is disposed along the length of the connector strip.

18. The combination of claim 15 wherein the sidewalls substantially hide the raised support surface from view.

19. The combination of claim 15 wherein the track rail includes a locking tab on one of the flanges and the bed includes an opening therein adjacent the tab, said tab being bent into the opening to restrain longitudinal movement of the track rail.

20. A track rail for a toy train comprising oppositely extending lateral flanges with each flange having a depending side wall and extending below the respective flange adjacent the lateral extremity of each flange.

21. The track rail of claim 20 wherein the depending side wall of the one flange is substantially parallel with the depending side wall of the other flange.

22. The track rail of claim 20 wherein the depending side walls of the flanges define a recess therebetween beneath the flanges.

23. A formed sheet metal track rail including oppositely extending lateral flanges, each flange being formed of a strip of sheet metal folded back upon itself to define a depending side wall and extending below the respective flange adjacent the lateral extremity of each flange.

24. The track rail of claim 23 wherein the depending side wall of each flange is substantially parallel with the side wall of the other flange.

25. The track rail of claim 23 wherein opposite edges of the folded sheet metal terminate in facing relation beneath the flanges.

* * * * *

UNITED STATES PATENT AND TRADEMARK OFFICE

CERTIFICATE OF CORRECTION

PATENT NO. : 4,771,943

DATED : September 20, 1988

INVENTOR(S) : Daniel J. Cooney and D. Michael Ledyard

It is certified that error appears in the above—identified patent and that said Letters Patent is hereby corrected as shown below:

Column 8, line 22, delete "and",
line 25, delete "the", and
line 33, delete "and".

Signed and Sealed this

Fourth Day of April, 1989

*Attest:*

*Attesting Officer*

DONALD J. QUIGG

*Commissioner of Patents and Trademarks*